US008113025B2

(12) United States Patent
Tapphorn et al.

(10) Patent No.: US 8,113,025 B2
(45) Date of Patent: Feb. 14, 2012

(54) TECHNIQUE AND PROCESS FOR CONTROLLING MATERIAL PROPERTIES DURING IMPACT CONSOLIDATION OF POWDERS

(76) Inventors: Ralph M. Tapphorn, Goleta, CA (US); Howard Gabel, Santa Barbara, CA (US)

( * ) Notice: Subject to any disclaimer, the term of this patent is extended or adjusted under 35 U.S.C. 154(b) by 689 days.

(21) Appl. No.: 12/207,725

(22) Filed: Sep. 10, 2008

(65) Prior Publication Data

US 2009/0065602 A1 Mar. 12, 2009

Related U.S. Application Data

(60) Provisional application No. 60/993,045, filed on Sep. 10, 2007.

(51) Int. Cl.
*B21D 53/10* (2006.01)
*B23P 25/00* (2006.01)

(52) U.S. Cl. ..... 72/53; 29/90.7; 451/38; 451/29

(58) Field of Classification Search ..... 72/53; 29/90.7; 451/38–39

See application file for complete search history.

(56) References Cited

U.S. PATENT DOCUMENTS

| | | | | | |
|---|---|---|---|---|---|
| 3,754,976 | A * | 8/1973 | Babecki et al. | ..... | 427/192 |
| 3,765,923 | A * | 10/1973 | Bender-Christensen | ..... | 427/205 |
| 3,787,191 | A * | 1/1974 | Duncan | ..... | 428/687 |
| 4,517,248 | A * | 5/1985 | Kik et al. | ..... | 428/457 |
| 4,552,784 | A * | 11/1985 | Chu et al. | ..... | 427/192 |
| 4,773,244 | A * | 9/1988 | Honda et al. | ..... | 72/46 |
| 5,302,414 | A | 4/1994 | Alkhimov et al. | | |
| 5,516,586 | A * | 5/1996 | Singer et al. | ..... | 428/433 |
| 5,795,626 | A | 8/1998 | Gabel et al. | | |
| 5,945,157 | A * | 8/1999 | Lee et al. | ..... | 427/198 |
| 6,074,135 | A | 6/2000 | Tapphorn et al. | | |
| 6,139,913 | A | 10/2000 | Van Steenkiste et al. | | |
| 6,403,165 | B1 * | 6/2002 | Grylls et al. | ..... | 427/456 |
| 6,598,441 | B1 * | 7/2003 | Cavaliere et al. | ..... | 72/47 |
| 6,715,640 | B2 | 4/2004 | Tapphorn et al. | | |
| 6,874,214 | B1 * | 4/2005 | Fader et al. | ..... | 29/90.7 |
| 6,881,500 | B2 * | 4/2005 | Sugiyama | ..... | 428/687 |
| 6,915,964 | B2 | 7/2005 | Tapphorn et al. | | |
| 7,273,075 | B2 | 9/2007 | Tapphorn et al. | | |
| 7,300,685 | B2 * | 11/2007 | Acx | ..... | 427/360 |

* cited by examiner

*Primary Examiner* — David Jones
(74) *Attorney, Agent, or Firm* — Paul D. Chancellor; Ocean Law

(57) ABSTRACT

Impact consolidated powders form deposits that are densified by substantially simultaneous shot peening of the impact consolidated powder.

1 Claim, 11 Drawing Sheets

CP-TI –325 MESH, 105 PSIA HELIUM AT 600° F

Coating Thickness: 4.37 mm, DE: 76.8%, Surface Porosity: 27.4%, Interior Porosity: 8.2%, Interface Porosity: 12.5%

CP-TI –325 MESH, 105 PSIA HELIUM AT 600° F, 10% VOL. STAINLESS STEEL SHOT

Coating Thickness: 4.36 mm, DE: 70.2%, Surface Porosity: 24.7%, Interior Porosity: 4.6%, Interface Porosity: 10.0%

CP-TI –325 MESH, 105 PSIA HELIUM AT 600° F, 30% VOL. STAINLESS STEEL SHOT

Coating Thickness: 3.71 mm, DE: 54.6%, Surface Porosity: 23.6%, Interior Porosity: 2.7%, Interface Porosity: 4.0%

CP-TI –325 MESH, 105 PSIA HELIUM AT 600°F, 50% VOL. STAINLESS STEEL SHOT

Coating Thickness: 3.52 mm DE: 38.2% Surface Porosity: 20.9% Interior Porosity: 1.7%
Interface Porosity: 1.5%

CP-TI –325 MESH, 105 PSIA HELIUM AT 600°F, 10% VOL. STAINLESS STEEL SHOT POST DEPOSITION SHOT PEENING WITH 100% STAINLESS STEEL SHOT TO CLOSE SURFACE POROSITY ON HALF OF SAMPLE

Unpeened surface porosity: 23.8% Peened surface porosity: 2.5% Interior: 4.7%

CP-TI –325 MESH, 105 PSIA HELIUM AT 600°F, 10% VOL. TUNGSTEN SHOT

Coating Thickness: 2.18 mm, Surface Porosity: 8.5%, Interior Porosity: 4.7%, Interface Porosity: 6.6%

CP-AL –140/+325 MESH, 105 PSIA HELIUM AT 600°F

Coating Thickness: 4.2 mm, Porosity: 5.6%, DE: 15.5%

CP-AL –140/+325 MESH, 105 PSIA HELIUM AT 600°F, 10% VOL. STAINLESS STEEL SHOT

Coating Thickness: 3.98 mm, Porosity: 1.1%, DE: 14.3%

TECHNIQUE AND PROCESS FOR CONTROLLING MATERIAL PROPERTIES DURING IMPACT CONSOLIDATION OF POWDERS

PRIORITY CLAIM AND INCORPORATIONS BY REFERENCE

This utility patent application claims the benefit of U.S. Prov. Pat. Appl. No. 60/993,045 filed Sep. 10, 2007 by applicant's Ralph M. Tappahorn, Goleta, Calif. and Howard Gabel, Santa Barbara, Calif.

This application incorporates by reference U.S. Pat. Nos. 6,915,964, 6,074,135, 5,795,626, 5,302,414, 6,139,913, 6,715,640, and 7,273,075 (application Ser. No. 11/348,654).

BACKGROUND OF THE INVENTION

1. Field of the Invention

The present invention relates to consolidations of powders and methods of consolidating powders.

2. Discussion of the Related Art

The impact consolidation process has been disclosed in numerous patents and patent applications including U.S. Pat. No. 6,915,964 issued to Tapphorn and Gabel, PCT Patent Application WO 02/085532 A1, EP Patent No. 1383610, U.S. Pat. No. 6,074,135 issued to Tapphorn and Gabel, U.S. Pat. No. 5,795,626 issued to Gabel and Tapphorn, U.S. Pat. No. 5,302,414 issued to Alkhimov, et al., and U.S. Pat. No. 6,139,913 issued to Van Steenkiste, et al. None of these patents describe or disclose the benefits of using in-situ shot peening media to enhance the density or modify the residual stresses of coatings or free-form fabricated structures while depositing powder materials using the impact consolidation processes. A recent Patent Application 20060090593 submitted by Liu describes a method of using in-situ non-ductile hard core agglomerate particles to deposit thin layers of coatings using the impact consolidation process called cold spray. Although the method described by Liu results in peening of the substrate to deposit thin coating layers by embedding a portion of the agglomerated metallic particles from the non-ductile hare core particles, it does not disclose a method of using a ductile shot peening media as a co-blended admixture to powders for the purpose of reducing the porosity of coatings or free-form fabricated structures during impact consolidation.

Several patents describe methods of both surface densification of materials and controlling residual stresses by post shot peening processes. U.S. Patent Application 20040197593 by Spoonamore, U.S. Patent Application 20050038516 by Chellappa discusses the use of shot peening as a post deposition process for closing surface pores of cold spray materials.

SUMMARY OF THE INVENTION

The present invention relates to various methods for modifying material properties during solid-state impact consolidation of coatings and free-form fabrication of structures. The invention discloses a new method for densification of coatings and free-form fabricated structures during, simultaneous to, and subsequent to impact consolidation and accretion of powders using the solid-state deposition process (hereafter referred to as "impact consolidation process") disclosed in U.S. Pat. No. 6,915,964 issued to Tapphorn and Gabel, PCT Patent Application WO 02/085532 A1, EP Patent No. 1383610, U.S. Pat. No. 6,074,135 issued to Tapphorn and Gabel, U.S. Pat. No. 5,795,626 issued to Gabel and Tapphorn, U.S. Pat. No. 5,302,414 issued to Alkhimov, et al., and U.S. Pat. No. 6,139,913 issued to Van Steenkiste, et al. Additionally, the invention relates to methods of controlling and modifying residual stresses in coatings and free-form fabricated structures through specific degrees of in-situ shot peening of the materials during impact consolidation.

The density of coatings and free-form fabrication of structures deposited via an impact consolidation of powders can be substantially improved through complementary mechanical impact peening that occurs in-situ to the powder deposition process and additionally as a post process shot peening of the material surfaces. Complementary in-situ shot peening is implemented in the invention by admixtures of shot peening media or medium (hereafter referred to as "shot peening media") co-blended with powders to induce a mechanical peening action during and simultaneous to deposition of powders via the impact consolidation process. The shot peening media is designed and selected to impart substantial and localized impact pressure to the coating material without embedding the shot peening media or contaminates thereof into the coating or free-from fabricated structure. Simultaneously the admixture concentration of shot peening media is designed to minimizing loss in deposition efficiency of the powder materials.

Post shot peening of the coatings and free form fabricated structures using conventional shot peening media and methods are also disclosed in this invention as a means to reduced surface porosity of materials and thereby densify the surfaces of coatings and free-form fabricated structure deposited using impact consolidation processes.

Likewise the invention relates to controlling the residual stresses in materials during impact consolidation by complementary and in-situ peening induced with an admixture of shot peening media co-blended with the coating powders to be deposited.

In an embodiment, a deposit comprising an impact consolidated powder has a post-deposition density increased by substantially simultaneous impacts of a non-depositing shot peening media. In an embodiment, a post-deposition stress is modified by substantially simultaneous impacts of a non-depositing shot peening media. In some embodiments, the shot peening media includes tungsten. In some embodiments the impact consolidated powder is commercially pure titanium and the shot peening media is stainless steel shot. In some embodiments the impact consolidated powder is commercially pure aluminum and the shot peening media is stainless steel shot.

Some embodiments include a plurality of coextensive layers, each layer comprising an impact consolidated powder and each layer having a post-deposition density increased by subsequent impacts by non-depositing shot peening media. In some embodiments a plurality of layers have a post-deposition stress modified by subsequent impacts by non-depositing shot peening media. In some embodiments the shot peening media includes tungsten. In some embodiments the impact consolidated powder is commercially pure titanium and the shot peening media is stainless steel shot. In some embodiments the impact consolidated powder is commercially pure aluminum and the shot peening media is stainless steel shot.

In various embodiments of the present invention, the types of coating powders are selected from a group, but are not limited to powders, consisting of metals, alloys, low temperature alloys, high temperature alloys, superalloys, braze fillers, metal matrix composites, nonmetals, ceramics, polymers and mixtures thereof. These types of coating powders were first disclosed in U.S. Pat. No. 6,915,964 issued to Tapphorn and Gabel for impact consolidation processes.

BRIEF DESCRIPTION OF THE DRAWINGS

The present invention is described with reference to the accompanying figures. These figures, incorporated herein and forming part of the specification, illustrate the present invention and, together with the description, further serve to explain the principles of the invention and to enable a person skilled in the relevant art to make and use the invention.

DETAILED DESCRIPTION OF THE PREFERRED EMBODIMENTS

In the following description of the preferred embodiments of the present invention, reference is made to the accompanying drawings which form a part hereof, and in which is shown by way of illustration specific embodiments in which the invention may be practiced. It is understood that other embodiments may be utilized and structural changes may be made without departing from the scope of the present invention.

Figure 1:
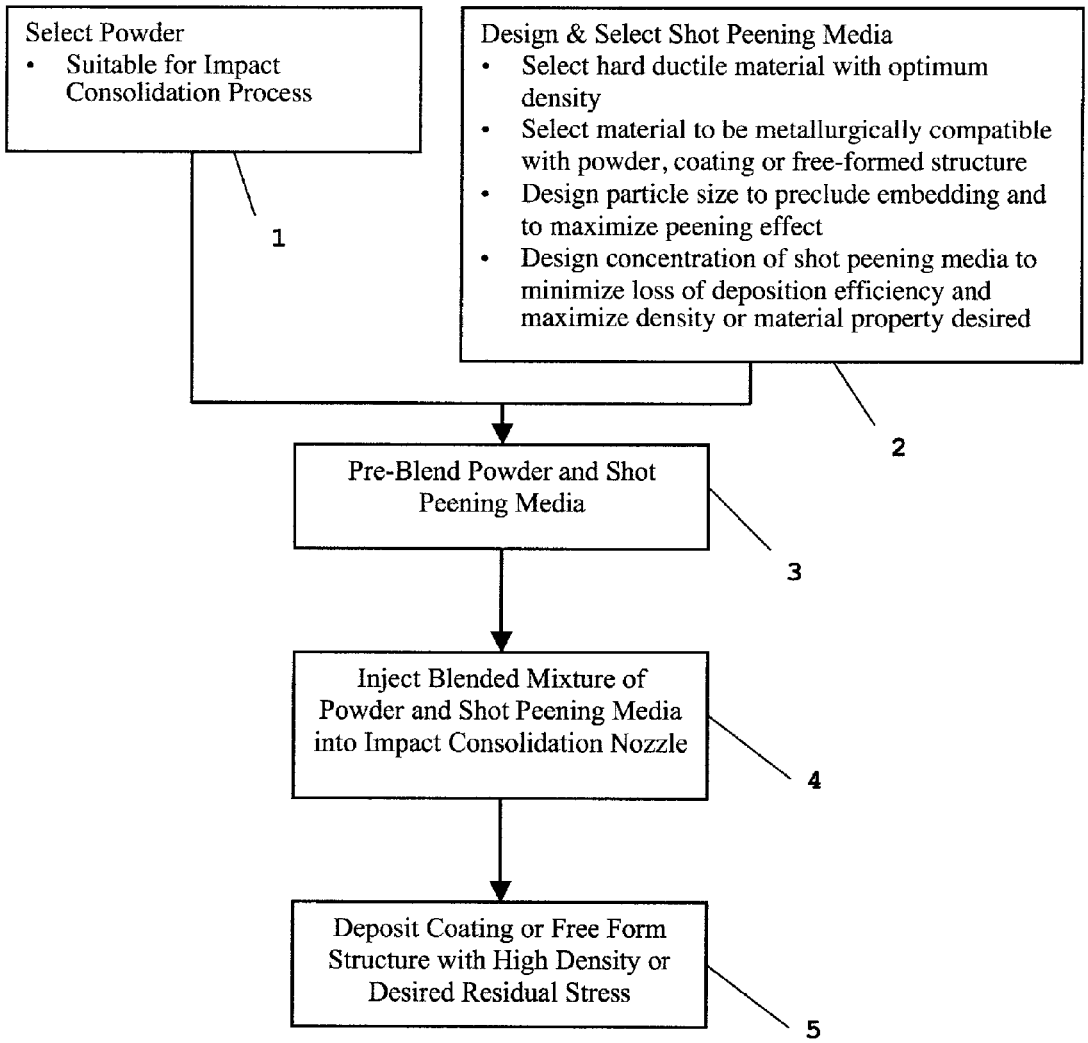
FIG. 1. Process diagram for one embodiment of the invention wherein shot peening media having specific ductile properties, material compatibility, density, and particle size distribution are pre-blended with powders suitable for impact consolidation and subsequently the blended combination of shot peening media with powder is injected or fed into impact consolidation nozzles for depositing dense coatings or free-formed structures of said powder material.

FIG. 1 shows process diagram for one embodiment of the invention method for modifying the properties of a coatings or free-form structures during the impact consolidation process of depositing powders as disclosed in U.S. Pat. No. 6,915,964 issued to Tapphorn and Gabel, PCT Patent Application WO 02/085532 A1, EP Patent No. 1383610, U.S. Pat. No. 6,074,135 issued to Tapphorn and Gabel, U.S. Pat. No. 5,795,626 issued to Gabel and Tapphorn, U.S. Pat. No. 5,302,414 issued to Alkhimov, et al., and U.S. Pat. No. 6,139,913 issued to Van Steenkiste, et al. In particular, the disclosed process of this invention reduces the porosity of coatings and free-form structures during the impact consolidation process by in-situ shot peening of the powder particles simultaneous to deposition of said powder. Additionally, the in-situ shot peening method of this invention can be used to modify the residual stresses in coatings and free-form fabricated structures as they are deposited with impact consolidation processes.

In various embodiments of the present invention, the types of coating powders are selected from a group, but are not limited to powders, consisting of metals, alloys, low temperature alloys, high temperature alloys, superalloys, braze fillers, metal matrix composites, nonmetals, ceramics, polymers and mixtures thereof. These types of coating powders were first disclosed in U.S. Pat. No. 6,915,964 issued to Tapphorn and Gabel for impact consolidation processes.

Referring now to FIG. 1, the process of the invention requires constituent formulation, Boxes 1 & 2. Box 1 shows design and selection of appropriate shot peening media and concentration thereof relative to the selected powder to be deposited using an impact consolidation process. Box 2 of the process diagram of FIG. 1 gives a list of selection and design criteria. Generally the shot peening media should be a hard ductile material, which will not fracture or embed in the coating or free-form fabricated material. The density of the shot peening media in combination with the particle size and size distribution of said shot peening material is selected to achieve optimum shot peening impact pressure. Optimum impact pressure is dependent on the design requirements for the process. For maximum densification of the powder, the impact pressure is maximized through an optimum combination of density of the shot peening media material, particle size, and impact velocity. Since the process precludes embedding of shot peening media within the deposited powder material, then specific particle sizes are dictated for a particular shot peening media. For example, if the shot peeing particle size is too small, then the shot peening media is easily embedded within the coating or free form fabricated structure which is not the objective of this invention. On the other hand, if the particle size of the shot peening media is too large, then it may not feed well or may not achieve an adequate impact velocity when accelerated through the impact consolidation nozzle.

Additionally, factors such as metallurgically compatibility with the powder, coating, or free-formed structure may further restrict the available materials than can be used for shot peening media. For example, although lead (Pb) is a highly dense material it would not make a good shot peening material as it would tend to deposit traces of lead (Pb) into the coating or free formed fabricated structure. Alternatively, tungsten would make an excellent peening media for depositing many types of powders using the impact consolidation process. Typically, the particle size for tungsten would be in the range of 50 to 150 mesh to achieve high impact pressure at velocities in the range of 50 to <500 m/s. Stainless steel shot peening media on the other hand would be in the particle size range of 50 to 325 mesh to achieve high impact pressure at velocities in the range of 50 to <500 m/s.

In most cases the optimum properties and characteristics of the shot peening media will have to be experimentally determined to achieve the desired material properties (density and/or residual stresses) of coatings or free-formed structures without embedding the shot peening material or contamination thereof within the deposited material.

Box 3 of FIG. 1 shows the process step of pre-blending of the powder with shot peening media to provide a blended mixture that is fed to impact consolidation nozzles using conventional powder feeders or feeders such as those disclosed in U.S. Pat. No. 6,715,640 issued to Tapphorn and Gabel or pending U.S. patent application Ser. No. 11/348,654 also by Tapphorn and Gabel. Injection of the blended mixture of powder and shot peening media into the nozzle of an impact consolidation process as depicted in Box 4 of the process diagram of FIG. 1 will permit deposition of high-density coatings or free-formed fabricated structures as indicated in Box 5 of FIG. 1.

Controlling the residual stresses in a coating or free-formed fabricated structure by in-situ and tailored shot peening during deposition of the powder material is yet another embodiment and purpose of the invention.

Figure 2:
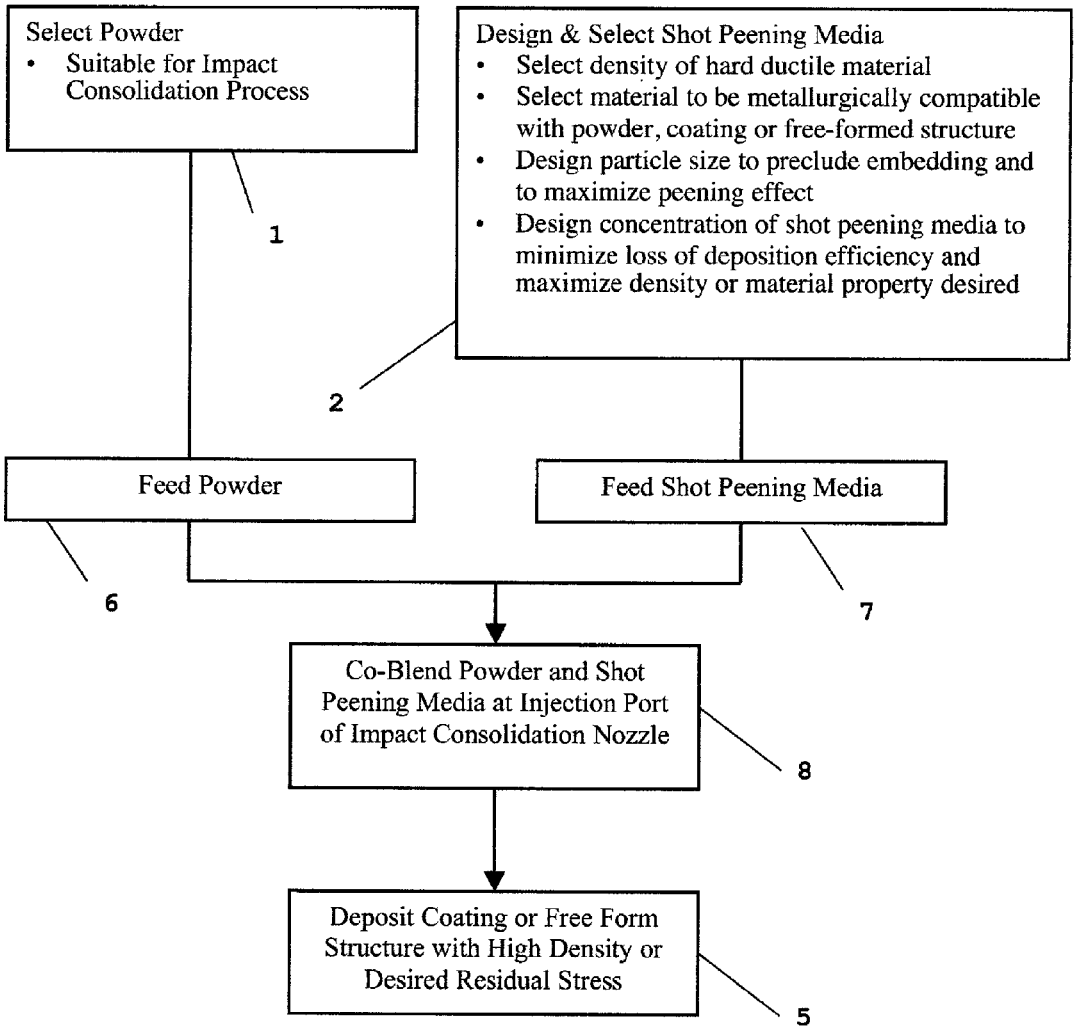
FIG. 2. Process diagram for second embodiment of the invention wherein shot peening media having specific ductile properties, material compatibility, density, and particle size distribution are co-injected or co-fed with powders for depositing dense coatings or free-formed structures of said powder material using impact consolidation processes.

FIG. 2 shows process diagram for second embodiment of the invention method for modifying the properties of a coatings or free-form structures during the impact consolidation process of depositing powders as disclosed in U.S. Pat. No. 6,915,964 issued to Tapphorn and Gabel, PCT Patent Application WO 02/085532 A1, EP Patent No. 1383610, U.S. Pat. No. 6,074,135 issued to Tapphorn and Gabel, U.S. Pat. No. 5,795,626 issued to Gabel and Tapphorn, U.S. Pat. No. 5,302,414 issued to Alkhimov, et al., and U.S. Pat. No. 6,139,913 issued to Van Steenkiste, et al.

Referring now to FIG. 2, the process of the invention requires design and selection of appropriate shot peening media and concentration thereof relative to the selected powder (Box 1 of FIG. 2) to be deposited using an impact consolidation process. Box 2 of the process diagram of FIG. 2 gives a list of selection and design criteria. Generally the shot peening media should be a hard ductile material, which will not fracture or embed in the coating or free-form fabricated material. The density of the shot peening media in combination with the particle size and size distribution of said shot peening material is selected to achieve optimum shot peening impact pressure. Optimum impact pressure is dependent on the design requirements for the process. For maximum densification of the powder, the impact pressure is maximized through an optimum combination of density of the shot peening media material, particle size, and impact velocity. Since the process precludes embedding of shot peening media within the deposited powder material, then specific particle sizes are dictated for a particular shot peening media. For example, if the shot peeing particle size is too small, then the shot peening media is easily embedded within the coating or free form fabricated structure which is not the objective of this invention. On the other hand, if the particle size of the shot peening media is too large, then it may not feed well or may not achieve an adequate impact velocity when accelerated through the impact consolidation nozzle.

Additionally, factors such as metallurgically compatibility with the powder, coating, or free-formed structure may further restrict the available materials than can be used for shot peening media. For example, although lead (Pb) is a highly dense material it would not make a good shot peening material as it would tend to deposit traces of lead (Pb) into the coating or free formed fabricated structure. Alternatively, tungsten would make an excellent peening media for depositing many types of powders using the impact consolidation process. Typically, the particle size for tungsten would be in the range of 50 to 150 mesh to achieve high impact pressure at velocities in the range of 50 to <500 m/s. Stainless steel shot peening media on the other hand would be in the particle size range of 50 to 325 mesh to achieve high impact pressure at velocities in the range of 50 to <500 m/s.

In most cases the optimum properties and characteristics of the shot peening media will have to be experimentally determined to achieve the desired material properties (density and/or residual stresses) of coatings or free-formed structures without embedding the shot peening material or contamination thereof within the deposited material.

Box 6 of FIG. 2 shows the process step of feeding the powder using conventional powder feeders or feeders such as those disclosed in U.S. Pat. No. 6,715,640 issued to Tapphorn and Gabel or pending U.S. patent application Ser. No. 11/348,654 also by Tapphorn and Gabel. Likewise, Box 7 of FIG. 2 shows the process of feeding shot peening media using conventional powder feeders or feeders such as those disclosed in U.S. Pat. No. 6,715,640 issued to Tapphorn and Gabel or pending U.S. patent application Ser. No. 11/348,654 also by Tapphorn and Gabel.

Box 8 of FIG. 2 shows the process of co-blending both the powder and shot peening media simultaneous to the injection of the mixture into the impact consolidation nozzle. This is accomplished by simultaneously feeding both the powder and the shot peening media into a single impact consolidation nozzle using a conventional bi-furcated inlet manifold having a single outlet into the impact consolidation nozzle.

Injection of the co-blended mixture of powder and shot peening media into the nozzle of an impact consolidation process as depicted in Box 8 of the process diagram of FIG. 2 will permit deposition of high-density coatings or free-formed fabricated structures as indicated in Box 5 of FIG. 2.

Controlling the residual stresses in a coating or free-formed fabricated structure by in-situ and tailored shot peening during deposition of the powder material is another embodiment and purpose of the invention.

Figure 3:
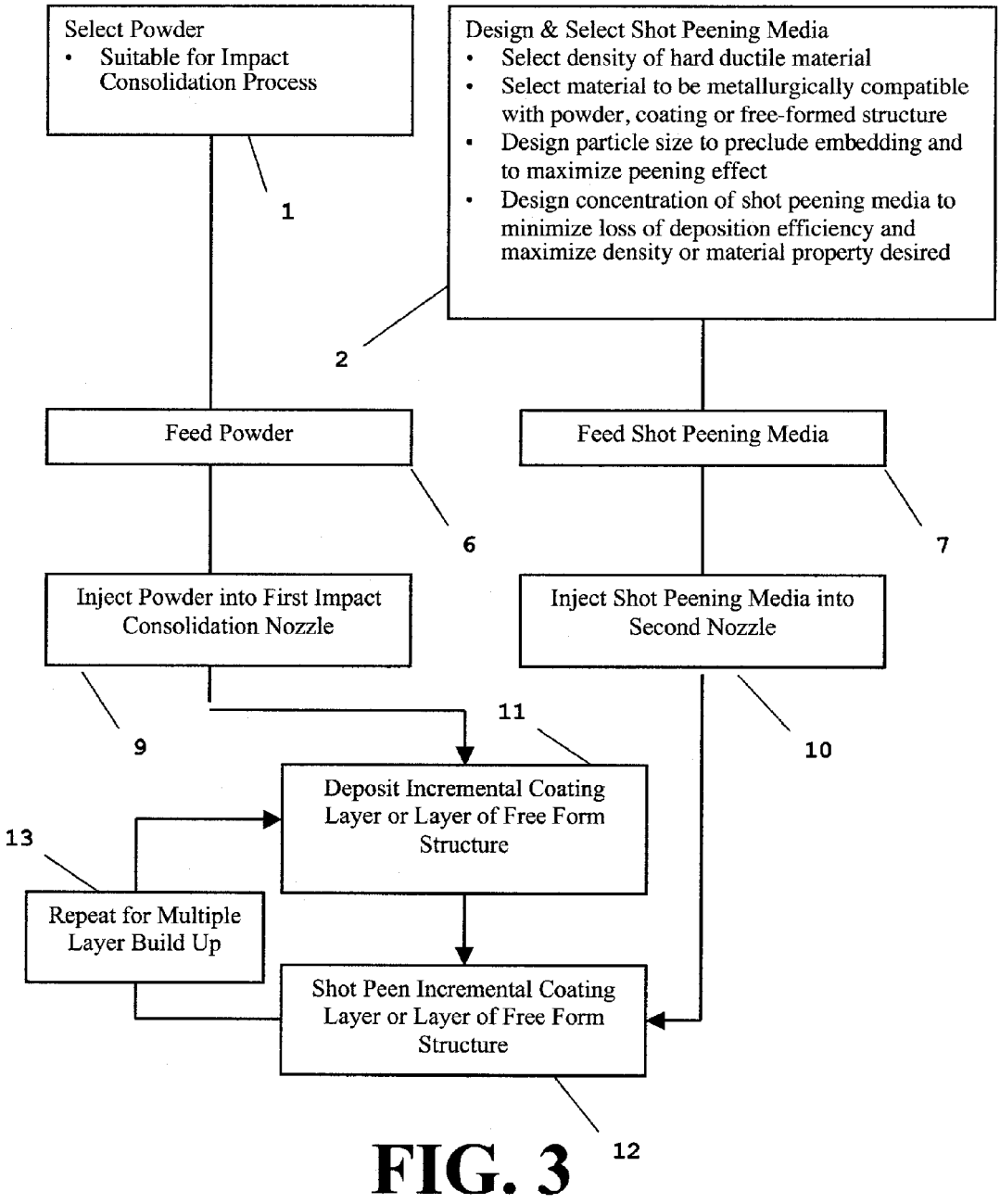
FIG. 3. Process diagram for third embodiment of the invention wherein shot peening media having specific ductile properties, material compatibility, density, and particle size distribution are used to shot peen intermediate layers of said powder deposited using impact consolidation processes in an alternating fashion between powder deposition and shot peening to achieve modified material properties of coating or free-form fabricated structure.

FIG. 3 shows process diagram for a third embodiment of the invention method for modifying the properties of a coatings or free-form structures during the impact consolidation process of depositing powders as disclosed in U.S. Pat. No. 6,915,964 issued to Tapphorn and Gabel, PCT Patent Application WO 02/085532 A1, EP Patent No. 1383610, U.S. Pat. No. 6,074,135 issued to Tapphorn and Gabel, U.S. Pat. No. 5,795,626 issued to Gabel and Tapphorn, U.S. Pat. No. 5,302,414 issued to Alkhimov, et al., and U.S. Pat. No. 6,139,913 issued to Van Steenkiste, et al.

Referring now to FIG. 3, the process of the invention requires design and selection of appropriate shot peening media and concentration thereof relative to the selected powder (Box 1 of FIG. 3) to be deposited using an impact consolidation process. Box 2 of the process diagram of FIG. 3 gives a list of selection and design criteria. Generally the shot peening media should be a hard ductile material, which will not fracture or embed in the coating or free-form fabricated material. The density of the shot peening media in combination with the particle size and size distribution of said shot peening material is selected to achieve optimum shot peening impact pressure. Optimum impact pressure is dependent on the design requirements for the process. For maximum densification of the powder, the impact pressure is maximized through an optimum combination of density of the shot peening media material, particle size, and impact velocity. Since the process precludes embedding of shot peening media within the deposited powder material, then specific particle sizes are dictated for a particular shot peening media. For example, if the shot peeing particle size is too small, then the shot peening media is easily embedded within the coating or free form fabricated structure which is not the objective of this invention. On the other hand, if the particle size of the shot peening media is too large, then it may not feed well or may not achieve an adequate impact velocity when accelerated through the impact consolidation nozzle.

Additionally, factors such as metallurgical compatibility with the powder, coating, or free-formed structure may further restrict the available materials than can be used for shot peening media. For example, although lead (Pb) is a highly dense material it would not make a good shot peening material as it would tend to deposit traces of lead (Pb) into the coating or free formed fabricated structure. Alternatively, tungsten would make an excellent peening media for depositing many types of powders using the impact consolidation process. Typically, the particle size for tungsten would be in the range of 50 to 150 mesh to achieve high impact pressure at velocities in the range of 50 to <500 m/s. Stainless steel shot peening media on the other hand would be in the particle size range of 50 to 325 mesh to achieve high impact pressure at velocities in the range of 50 to <500 m/s.

In most cases the optimum properties and characteristics of the shot peening media will have to be experimentally determined to achieve the desired material properties (density and/or residual stresses) of coatings or free-formed structures without embedding the shot peening material or contamination thereof within the deposited material.

Box 6 of FIG. 3 shows the process step of feeding the powder using conventional powder feeders or feeders such as those disclosed in U.S. Pat. No. 6,715,640 issued to Tapphorn and Gabel or pending U.S. patent application Ser. No. 11/348,654 also by Tapphorn and Gabel. Likewise, Box 7 of FIG. 3 shows the process of feeding shot peening media using conventional powder feeders or feeders such as those disclosed in U.S. Pat. No. 6,715,640 issued to Tapphorn and Gabel or pending U.S. patent application Ser. No. 11/348,654 also by Tapphorn and Gabel.

Box 9 of FIG. 3 shows the process step for injecting the powder into the impact consolidation nozzle for deposition. Likewise, Box 10 of FIG. 3 shows the process of injecting shot peening media into a second nozzle for subsequent and repetitive shot peening of an incrementally deposited coating layer or a layer of a free-formed structure as depicted by the process steps of Boxes 11, 12, and 13.

Controlling the residual stresses in a coating or free-formed fabricated structure by in-situ and tailored shot peening during deposition of the powder material is another embodiment and purpose of the invention.

EXAMPLE 1

Figure 4:
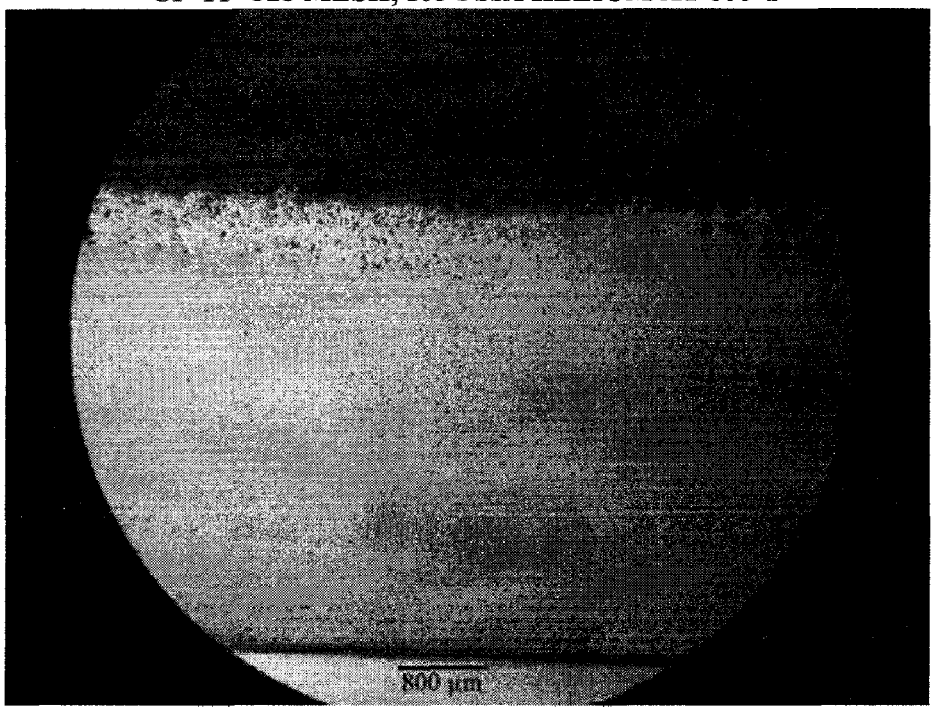
FIG. 4. Light micrograph cross-section of CP-titanium coating deposited with CP-Ti powder suitable for use with the friction compensated sonic nozzles disclosed in U.S. Pat. No. 6,915,964 at deposition parameters and conditions that typically yield a coating or free-form structure having porosities in excess of 5% by volume.

FIG. 4 shows a light micrograph coating cross-section of commercially pure titanium [(CP-Ti) −325 mesh] powder deposited with an impact consolidation process using the friction compensated sonic nozzle disclosed in U.S. Pat. No. 6,915,964 issued to Tapphorn and Gabel. This −325 mesh CP-Ti powder was deposited on an aluminum alloy substrate to a total thickness of approximately 4.4-mm using helium gas at a nozzle inlet pressure of 105-psia and nozzle temperature of approximately 600° F. The deposition efficiency for this −325 mesh CP-Ti powder is approximately 77%.

Note the high degree of porosity (8% by volume) occurring throughout the interior bulk region of the CP-Ti coating with a surface porosity as high as 27% extending 0.8-mm below the surface to the coating. Additionally the coating exhibits an interface porosity of approximately 12% near the aluminum alloy substrate.

Figure 5:
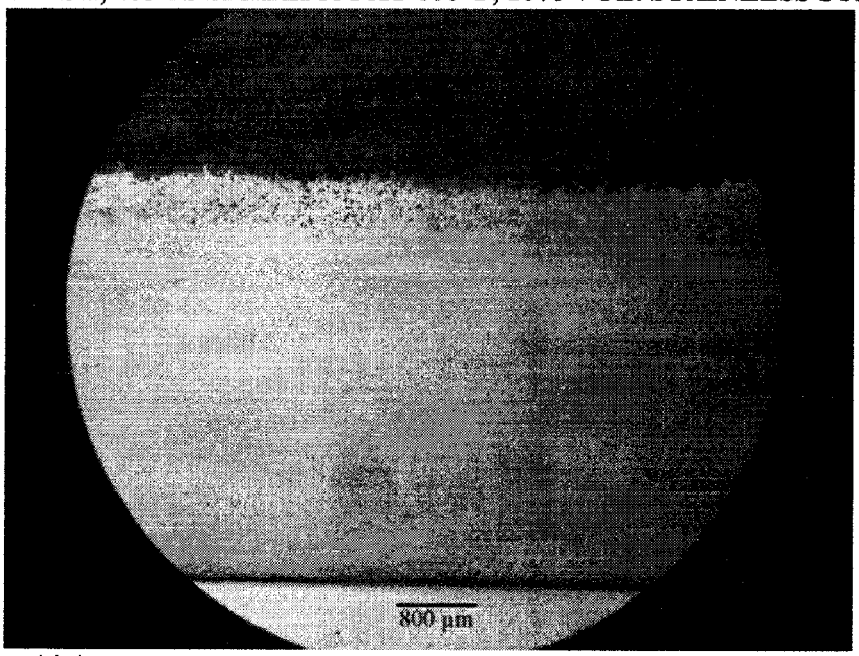
FIG. 5 Light micrograph cross-section of CP-titanium coating deposited using a pre-blended mixture of CP-Ti powder and 10% by volume of shot peening media comprising stainless steel shot (−50 mesh). Note the improved density of the coating throughout the material with the exception of the top and interface layer which has not been sufficiently shot peened to reach full density.

In contrast, FIG. 5 shows a light micrograph coating cross section of commercially pure titanium [(CP-Ti)-325 mesh] powder blended with a shot peening media deposited with an impact consolidation process using the same friction compensated sonic nozzle disclosed in U.S. Pat. No. 6,915,964 issued to Tapphorn and Gabel. The embodiment described by FIG. 1 for blending of shot peening media with a selected deposition powder to be deposited by an impact consolidation process was employed for demonstrating this example.

The shot peening media used to deposit the coating layer of FIG. 5 was stainless steel shot having nominal particle size distribution of −50+140 mesh and was blended to a concentration of 10% by volume with the −325 CP-Ti powder. This CP-Ti powder with blended stainless steel shot was deposited on an aluminum alloy substrate using the same conditions as cited above for deposition of the CP-Ti powder only, however the deposition efficiency is reduced to approximately 70%. Helium gas was used at a nozzle inlet pressure of 105-psia and nozzle temperature of approximately 600° F. In this case, the interior bulk porosity of the coating layer was reduced to <5% by volume, while the surface porosity still remained as high as 25% over a thickness of approximately 0.4-mm. The interface porosity on this specimen is still approximately 10% by volume extending over a thickness of approximately 1-mm.

Figure 6:
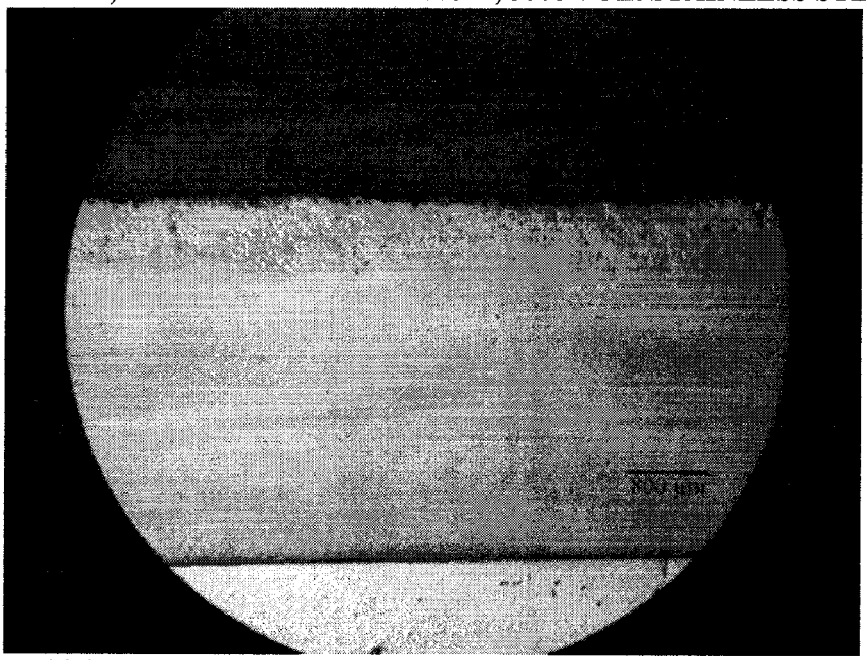
FIG. 6. Light micrograph cross-section of CP-titanium coating deposited using a pre-blended mixture of CP-Ti powder and 30% by volume of shot peening media comprising stainless steel shot (−50 mesh). Note porosity of the coating has been reduced to <3% by volume throughout the material with the exception of the top layer which has not been sufficiently shot peened to reach full density.

FIG. 6 shows a light micrograph of similar coating deposition in which the concentration of the stainless-steel shot peening media was increased to 30% by volume and blended with −325 mesh CP-Ti powder. Now, the coating porosity under the similar impact consolidation conditions (helium gas at a nozzle inlet pressure of 105-psia and nozzle temperature of approximately 600° F.) was significantly reduced to <3% by volume within in the bulk interior of the coating. The deposition efficiency of the powder has been reduced to approximately 55%. The interface porosity is also nearly negligible (<4%), while the surface porosity still remains at approximately 24% over a thickness of 0.6-mm.

Figure 7:
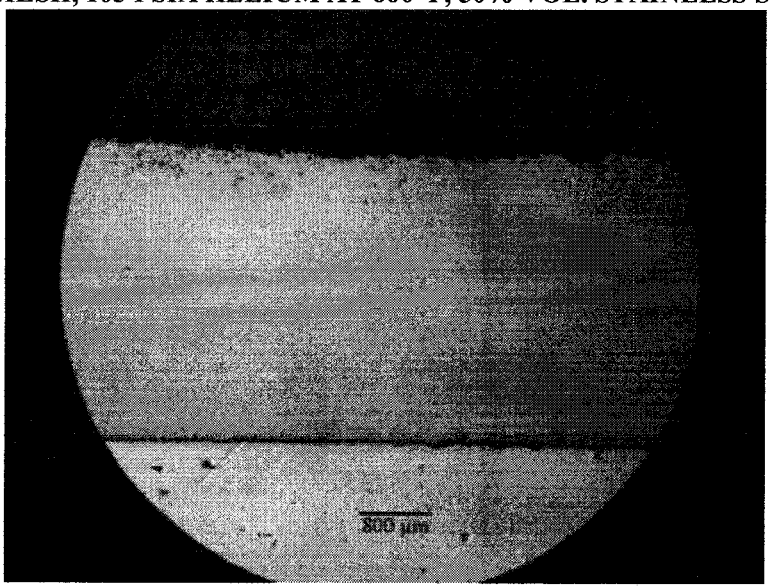
FIG. 7. Light micrograph cross-section of CP-titanium coating deposited using a pre-blended mixture of CP-Ti powder and 50% by volume of shot peening media comprising stainless steel shot (−50 mesh). Note porosity of the coating has been further reduced to <2% by volume throughout the material with the exception of the top layer, which still retains 20% porosity. Deposition efficiency has been reduced from 77% for un-peened material to approximately 40%, which is generally unacceptable or unfavorable for using such high concentrations of shot peening media.

FIG. 7 shows that the interior bulk porosity can be reduced to <2% by further increasing the stainless steel shot peening concentration to 50% by volume compared the −325 mesh CP-Ti powder. Although, the porosity has been reduced to nearly a negligible level for coatings, it has been achieved at the expense of significantly reducing the deposition efficiency from 77% to 38% by adding this much shot peening media (50% by volume).

Thus, an optimized concentration for the −50+140 mesh stainless steel shot peening media in −325 mesh CP-Ti powder would be predicted to be in the range of 25-30% by volume to achieve a the bulk porosity of <3% while maintaining a respectable minimum deposition efficiency of 50%.

Figure 8:
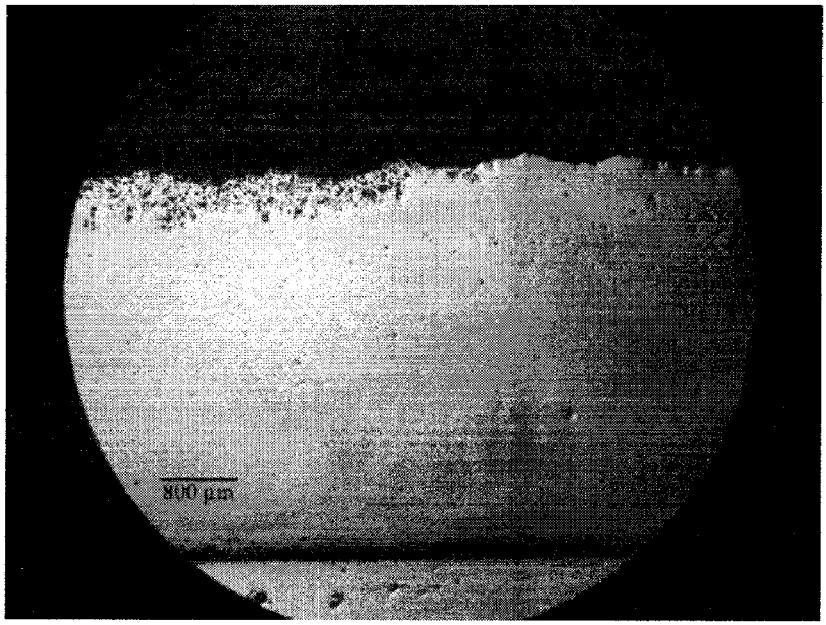
FIG. 8. Light micrograph cross-section of CP-titanium coating deposited using a pre-blended mixture of CP-Ti powder and 10% by volume of shot peening media comprising stainless steel shot (−50 mesh). Note, right hand side of micrograph shows effect of post surface shot peening using 100% stainless steel media to reduce surface porosity from approximately 25% to <2.5% under comparable spray conditions for the friction compensated sonic nozzle disclosed in U.S. Pat. No. 6,915,964.

Reduction of the surface porosity characteristic of impact consolidation of CP-Ti powders from 25-30% by volume to <2.5% over a thickness or approximately 1-mm, can be achieved by performing a post deposition shot peening of the final surface as show in the light micrograph of FIG. 8 where only half of the surface has been subjected to a post deposition shot peening. The conditions employed for the post deposition shot peening with −50+140 mesh stainless-steel shot was achieved using helium gas at a nozzle inlet pressure of 105-psia and nozzle temperature of approximately 600° F. inject through a friction compensate nozzle as disclosed in U.S. Pat. No. 6,915,964 issued to Tapphorn and Gabel.

Thus, through this example, one embodiment of the invention was reduced to practice and demonstrated to be beneficial in improving the density of the coating or free form fabricated structure through the design and use of an auxiliary shot peening media pre-blended with the powder to be deposited. Other properties of the coating including residual stress could likewise be controlled and tailored using a pre-blended mixture of shot peening media with a desired coating powder.

Figure 9:
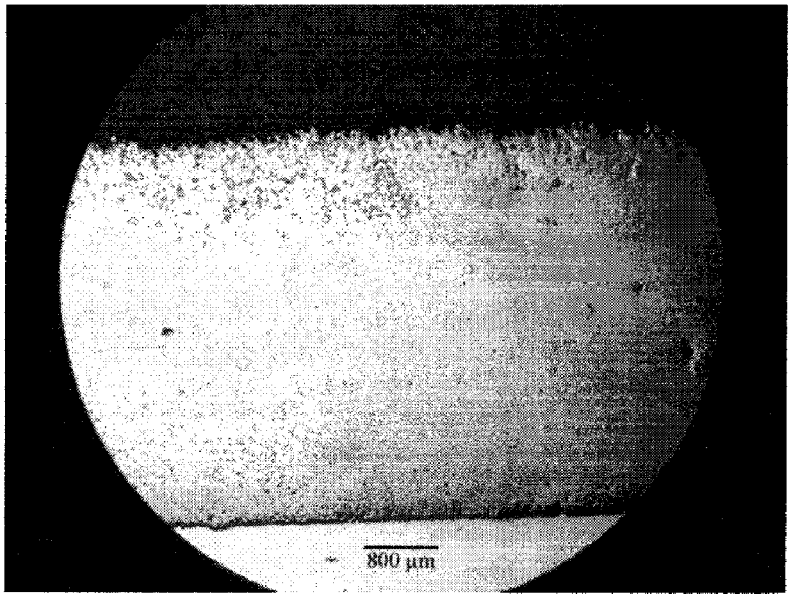
FIG. 9. Light micrograph cross-section of CP-titanium coating deposited using a pre-blended mixture of CP-Ti powder and 10% by volume of shot peening media comprising tungsten shot (−50 mesh). Note the porosity reduction is comparable to that achieved with stainless steel shot for the same volumetric loading of the blended mixture.

Other shot peening media such as metallic tungsten can likewise by used to reduce porosity in coatings or free form fabricated structures by pre-blending with the coating powder. FIG. 9 shows that a 10% by volume of tungsten shot peening media (−50 mesh) was able to achieve nearly the same effect in reducing porosity of the −325 mesh CP-Ti from 10% to <5% as the same concentration of stainless steel shot peening media.

EXAMPLE 2

A second example of using the embodiment described with FIG. 1, was evaluated using commercially pure aluminum powder (CP-Al) having a particle size distribution of −140 to +325 mesh. The powder was initially deposited with an impact consolidation process using the friction compensated sonic nozzle disclosed in U.S. Pat. No. 6,915,964 issued to Tapphorn and Gabel. This CP-Al powder was deposited on an aluminum alloy substrate to a total thickness of approximately 4.2-mm using helium gas at a nozzle inlet pressure of 105-psia and nozzle temperature of approximately 600° F. The deposition efficiency for this CP-Al powder is approximately 15% which is low for aluminum powders, but was selected as a coarse aluminum powder example with a relatively high porosity when deposited using the impact consolidation process unique to the friction compensated sonic nozzle disclosed in U.S. Pat. No. 6,915,964 issued to Tapphorn and Gabel operating at relative low input pressures.

Figure 10:
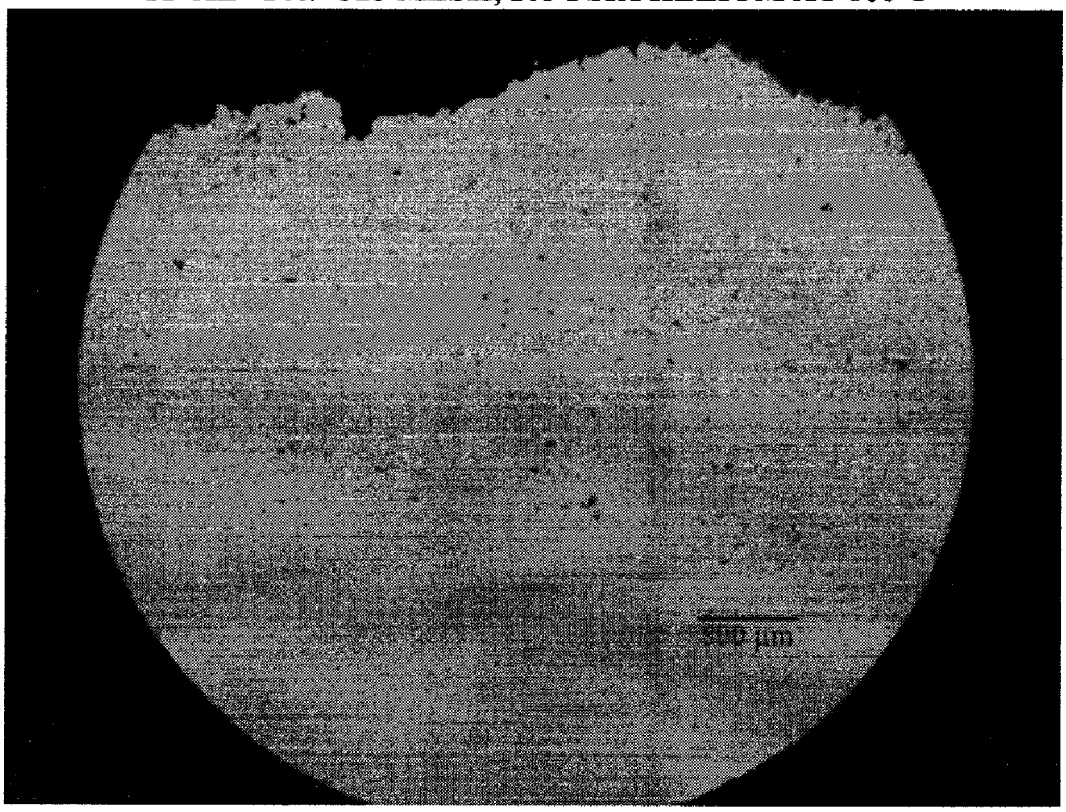
FIG. 10. Light micrograph cross-section of CP-aluminum coating deposited with coarse CP-Al powder (−140/+325 mesh) considered un-optimized for use with the friction compensated sonic nozzles disclosed in U.S. Pat. No. 6,915,964. This powder typically yields a coating or free-form structure having porosities in excess of 5% by volume with low deposition efficiency of approximately 15%.
Figure 11:
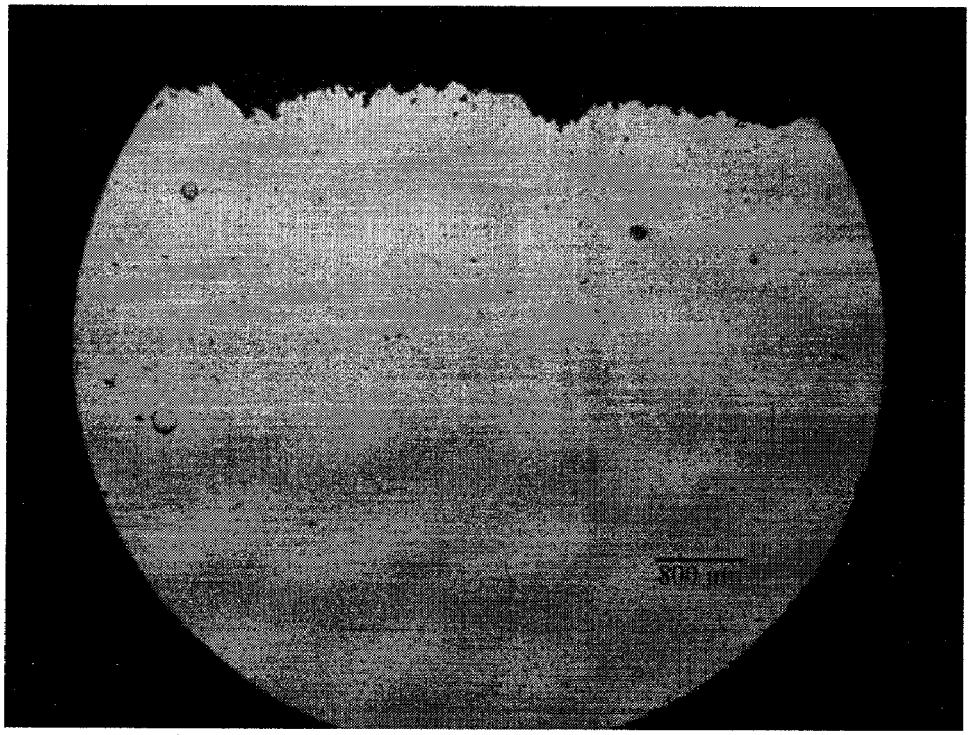
FIG. 11. Light micrograph cross-section of CP-aluminum coating deposited using a pre-blended mixture of CP-Al powder (−140/+325 mesh) and 10% by volume of shot peening media comprising stainless steel shot (−50 mesh). Note the porosity is reduced to approximately 1% by volume while the deposition efficiency was only marginally affected.

FIG. 10 shows the light micrograph cross-section of the CP-Al coating example to have a porosity of approximately 6% by volume when deposited without using an in-situ pre-blended shot peening media. By adding 10% by volume of stainless steel shot peening media to coarse grade CP-Al (−140 to +325 mesh) powder, the porosity was reduced to approximately 1% by volume with only a small reduction in deposition efficiency for this particular powder as shown in the light micrograph cross-section of FIG. 11.

What is claimed is:

1. A method of increasing the density of an impact consolidated powder layer comprising the steps of:

formulating a powder suitable for impact consolidation;

formulating a media suitable for shot peening deposits of the powder;

entraining the powder in a gas jet of a first suitable nozzle directed at a substrate to be coated;

depositing a layer of consolidated powder on the substrate;

for the layer just deposited and while on such layer no further powder deposit is being made, densifying the layer by entraining the shot peening media in a gas jet of a second suitable nozzle directed at said layer; and, repeating the entraining, depositing and densifying steps to produce a plurality of layers.

* * * * *